US008866031B2

(12) United States Patent
Chiang

(10) Patent No.: US 8,866,031 B2
(45) Date of Patent: Oct. 21, 2014

(54) SLIM KEYPAD STRUCTURE AND ELECTRONIC DEVICE USING THE SAME

(75) Inventor: Hsiao-Lung Chiang, Taipei (TW)

(73) Assignees: Lite-On Electronics (Guangzhou) Limited, Guangzhou (CN); Lite-On Technology Corporation, Taipei (TW)

( * ) Notice: Subject to any disclaimer, the term of this patent is extended or adjusted under 35 U.S.C. 154(b) by 365 days.

(21) Appl. No.: 13/295,173

(22) Filed: Nov. 14, 2011

(65) Prior Publication Data

US 2013/0002557 A1 Jan. 3, 2013

(30) Foreign Application Priority Data

Jul. 1, 2011 (CN) ..... 2011 1 0182508

(51) Int. Cl.
*H01H 9/00* (2006.01)
*H01H 13/7065* (2006.01)

(52) U.S. Cl.
CPC ..... *H01H 13/7065* (2013.01); *H01H 2237/004* (2013.01); *H01H 2219/036* (2013.01); *H01H 2229/042* (2013.01); *H01H 2233/034* (2013.01); *H01H 2221/05* (2013.01); *H01H 2233/074* (2013.01); *H01H 2221/006* (2013.01); *H01H 2227/036* (2013.01)
USPC ..... 200/313; 200/314

(58) Field of Classification Search
CPC ..... H01H 13/83; H01H 13/70; H01H 13/85; H01H 13/705; H01H 13/704
USPC ..... 200/313, 314
See application file for complete search history.

(56) References Cited

U.S. PATENT DOCUMENTS

| | | | | |
|---|---|---|---|---|
| 7,294,794 | B2 * | 11/2007 | Choi et al. | 200/5 A |
| 7,361,853 | B2 * | 4/2008 | Clegg et al. | 200/5 A |
| 2011/0073454 | A1 * | 3/2011 | Chen et al. | 200/5 A |

* cited by examiner

*Primary Examiner* — Renee S Luebke
*Assistant Examiner* — Lheiren Mae Caroc
(74) *Attorney, Agent, or Firm* — Li & Cai Intellectual Property (USA) Office

(57) ABSTRACT

A slim key includes a supporting plate, at least one key cap, at least one dome and a light-permeable circuit board. The supporting plate is disposed above the circuit board and has at least one frame part. Each frame part is formed with a light-permeable hole at a central portion thereof. The key pad is disposed on the top surface of the frame part correspondingly. The circuit board has at least one conductive circuit formed thereon under the dome correspondingly. The dome is correspondingly disposed between the frame part and the circuit board. According to one embodiment, the instant disclosure also provides an electronic device with the slim keypad structure.

23 Claims, 9 Drawing Sheets

SLIM KEYPAD STRUCTURE AND ELECTRONIC DEVICE USING THE SAME

BACKGROUND OF THE INVENTION

1. Field of the Invention

The instant disclosure is related to a slim keypad structure and electronic devices utilizing the same. In particular, the instant disclosure relates to a slim keypad structure particularly suitable for implementation in modern low-profile electronics, and an electronic device incorporating the slim keypad structure.

2. Description of Related Art

Speedy development of portable smart electronics, such as mobile phone, PDA, and tablet PC, constantly pushes the demand for devices having lower physical profile. With the improvement of touch-screen control interface, more and more electronic devices abandon the structural keypad in favor of the touch-screen input solution. However, the touch-screen operating interface cannot provide the affirmative tactile feedback of a structural keypad.

Obviously, the key structure needs further refinement to improve its compatibility and adaptability with the development trend of slim and light electronic device. The key structure is required be slim, structurally simple, and easy to assemble, so that it can match with the development trend of modern electronic devices.

Moreover, having limited available space, modern portable devices are often equipped with multi-functional software configurable keypads that have fewer keys than that of a conventional keyboard. Such keypads often have multiple alphabet/symbols printed the top surface of each key which in turn makes key identification confusing and difficult.

Therefore, it is desirable to propose a novel slim keyswitch to overcome the above-mentioned problems.

SUMMARY OF THE INVENTION

The instant disclosure provides a slim keypad structure that is structurally thin, simple, and easy to assemble, and is capable of providing affirmative tactile feedback.

The instant disclosure further provides a slim keypad structure, in which the same keypad structure can show different symbols to enhance the flexibility of operation.

In order to achieve the above objectives, the instant disclosure is to provide a slim keypad structure, which includes a supporting plate, at least one key cap, at least one dome, and a light-penetrable circuit board. The supporting plate has at least one frame portion, and each frame portion is formed with a light-pervious opening at a central portion thereof. The key cap is disposed on a top surface of the frame portion correspondingly. The circuit board has at least one conducted circuit formed under the dome correspondingly, wherein the supporting plate is arranged above the circuit board with an interval. The dome is disposed under the frame portion correspondingly.

According to one embodiment of the instant disclosure, the key cap is board-shaped and is light-penetrable.

According to one embodiment of the instant disclosure, further includes a displaying element to shown at least one symbol. The symbol is shown on a top surface of the key cap through the circuit board and the light-pervious opening of the supporting plate.

Moreover, the instant disclosure provides an electronic device with slim keypad structure.

In order to achieve the above objectives, one embodiment according to the instant disclosure provides an electronic device with slim keypad structure. The slim keypad structure includes a supporting plate, at least one key cap, at least one dome, and a light-penetrable circuit board. The supporting plate at least one frame portion, and each frame portion is formed with a light-pervious opening at a central portion thereof. The key cap is disposed on a top surface of the frame portion correspondingly. The circuit board has at least one conducted circuit correspondingly formed under the dome, wherein the supporting plate is arranged above the circuit board with an interval. The dome is disposed under the frame portion correspondingly.

Thus, the instant disclosure has advantages as followed. The slim design reduces the thickness of the electronic device effectively. The same keypad structure can show different symbols, so that the operation is more flexible For further understanding of the instant disclosure, reference is made to the following detailed description illustrating the embodiments and examples of the instant disclosure. The description is for illustrative purpose only and is not intended to limit the scope of the claim.

DETAILED DESCRIPTION OF THE PREFERRED EMBODIMENTS

In order to better understand the objective, structure, characteristics, and effects of the instant disclosure, a description relating thereto will be made with reference to preferred embodiments thereof and the accompanying drawings.

Figure 1:
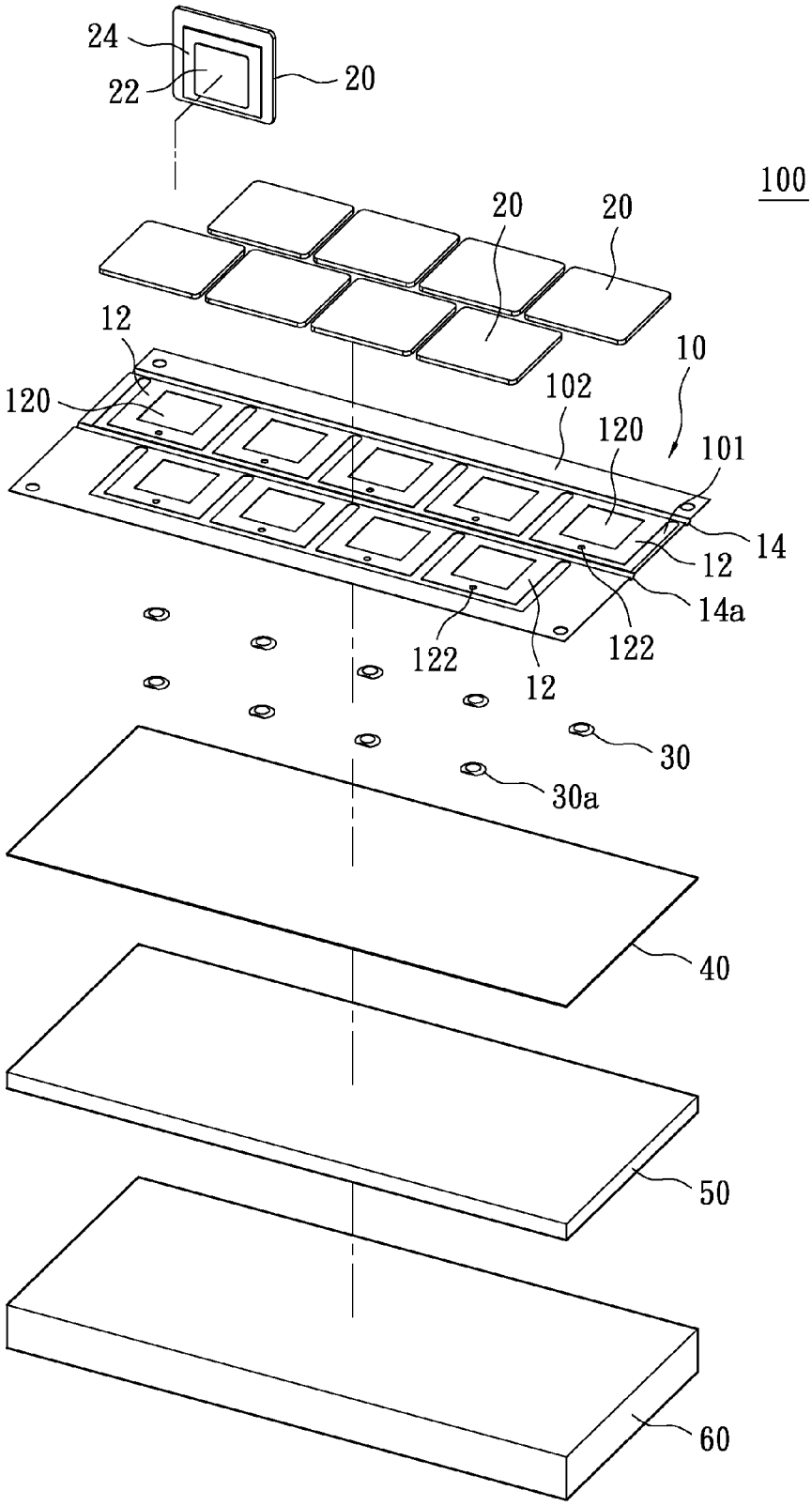
FIG. 1 is a perspective exploded view of slim keypad structure according to the instant disclosure.
Figure 2:
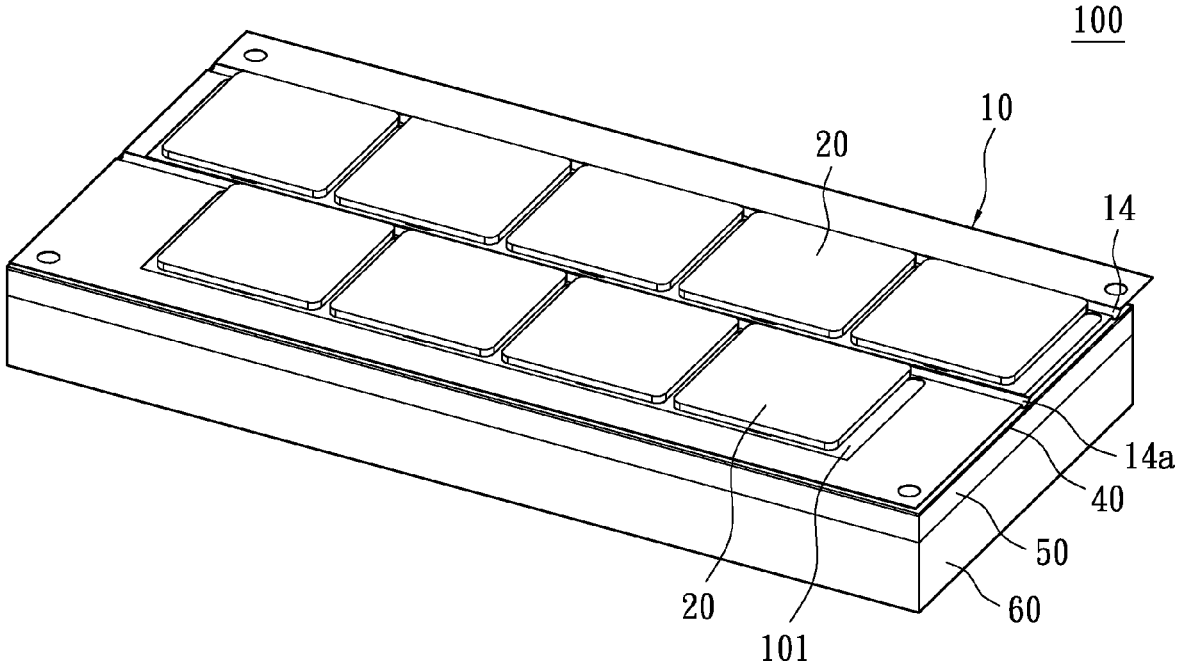
FIG. 2 is a perspective assembled view of slim keypad structure according to the instant disclosure.

Reference is made to FIGS. 1 and 2, which are a perspective exploded view and a perspective assembled view of slim keypad structure according to the instant disclosure. A slim keypad structure 100 according to the instant disclosure includes a supporting plate 10, a plurality of key caps 20 disposed on the supporting plate 10, a plurality of domes 30 disposed under the supporting plate 10 and a circuit board 40 formed with conductive circuits (not shown). The domes 30 are disposed on the circuit board 40. The slim keypad structure 100 of instant disclosure can be independently applied as one keypad structure or multiple keypad structure in a multi-rows configuration. In this embodiment, two rows of keypad structure are illustrated as example, namely, the key caps 20 are arranged in two rows. The details are introduced as follows.

The supporting plate 10 is disposed above the circuit board 40 with an interval, and is used to elastically support the key cap 20. Thus, elasticity is provided to the key cap 20, and the key cap 20 can be restored to the original position after being pressed. The supporting plate 10 has a plurality of frame portions 12. Each of the frame portions 12 is formed with a light-pervious opening 120 at a center thereof. In this embodiment the frame portion 12 is rectangle-shaped, but it is not limited thereto. For example, it can be shaped in polygon or semicircle, which just forms a frame structure to elastically support key cap 20. The shape of the light-pervious opening 120 is not limited in rectangle as shown in this embodiment, which is allowed to light permit through and can reduce the weight of the supporting plate 10.

When the slim keypad structure of the instant disclosure is applied in one single keypad structure, which needs only one frame portion 12. In other words, the number of the frame portion 12 could be at least one. The instant disclosure makes the keypad structure slim though the supporting plate 10. The supporting plate 10 can be a metal board by punched or made of plastic.

Figure 3:
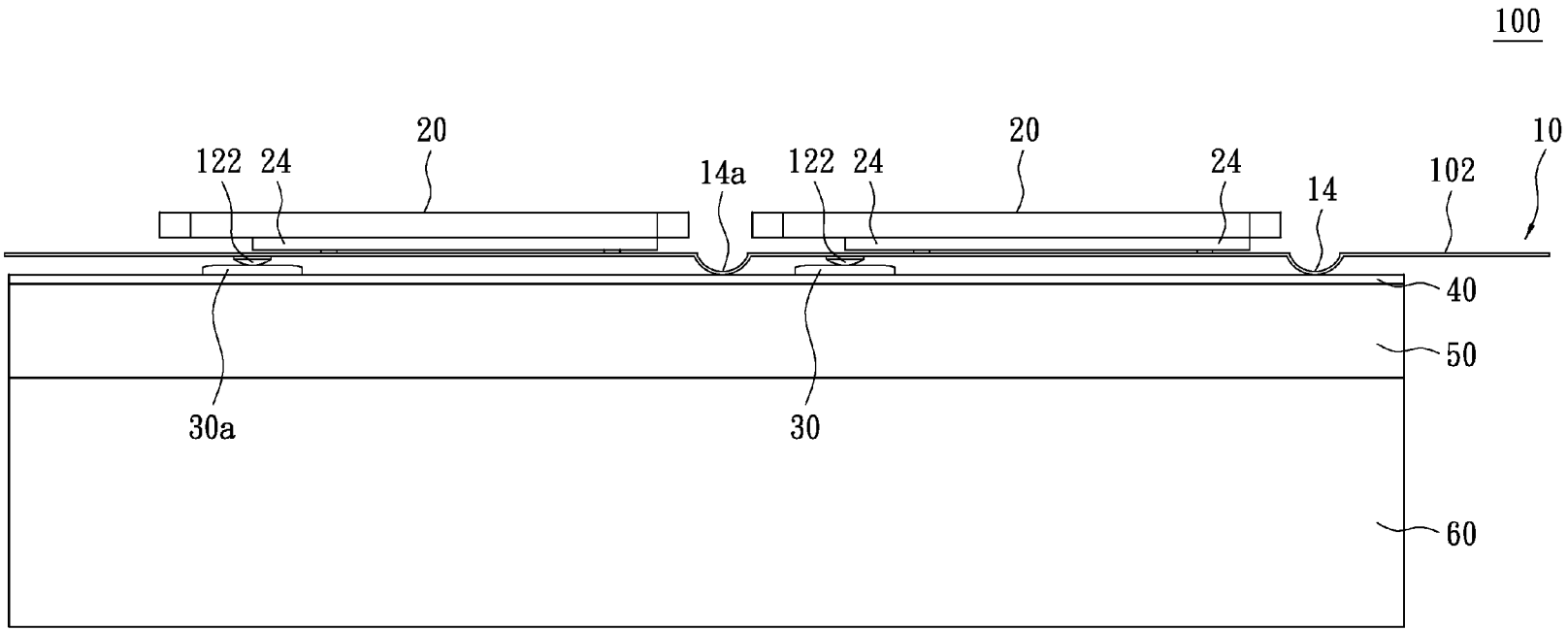
FIG. 3 is a side view of slim keypad structure according to the instant disclosure.

According to this embodiment, to uplift the supporting plate 10 above the circuit board 40, the supporting plate 10 has an uplifted portion 14 protruded downward from an edge of the frame portion 12. The uplifted portion 14 is downward arc-shaped and parallel to one side of the frame portion 12, as shown in FIG. 3. In side view, the uplifted portion 14 is shaped in half-cylinder with an arc-shaped groove. The uplifted portion 14 is used to uplift the frame portion 12 with a predetermined height, so that the frame portion 12 is suspended in midair and provides the key cap 20 a recovery force after being pressed. However, the way to uplift the supporting plate 10 of this instant disclosure is not limited to this embodiment.

The figures of this embodiment are illustrated with a keypad structure arranged in a multi-row configuration, i.e., the supporting plate 10 has a plurality of frame portions 12 which are arranged in two rows. Each row of the frame portions 12 has an uplifted portion 14 and 14*a* arranged in a straight line at the front edge thereof. Each frame portion 12 has an outer edge formed a substantial U-shaped hollowed slot 101. The straight-shaped uplifted portion 14 connects many frame portions 12 and is arranged in rows. The hollowed slot 101 makes each of the frame portions 12 been able to press independently. The size of the key cap 20 is slightly larger than that of the frame portion 12, and the edge of the key cap 20 is located in the hollowed slot 101.

Referring to FIGS. 1 and 3, wherein FIG. 3 is side view of the slim keypad structure. In this embodiment, the frame portion 12 further includes a downward bump 122 above the dome 30, and is formed on the frame portion 12 where far away the uplifted portion 14*a*. The bump 122 is against the dome 30 correspondingly, and can reduce the pressing stroke of the frame portion 12 and avoid affecting the neighbor frame portion 12, such as being raised, when the key cap 20 is pressed.

Referring to FIGS. 1 and 3, the key caps 20 are correspondingly disposed on a top surface of the frame portions 12. The key cap 20 may be slab-shaped and made of transparent material, such as plastic, making it pervious to light. Each of the key caps 20 has a positioning protrusion 22 protruded from a bottom surface thereof. The positioning protrusion 22 is correspondingly shaped to wedge in the light-pervious opening 120 in such a way that allows the key cap 20 to be fixed onto the frame portion 12. In this embodiment, the thickness of the positioning protrusion 22 is substantially equal to or slightly larger the frame portion 12. In FIG. 3, the positioning protrusion 22 is not exposed beyond the bottom surface of the frame portion 12, but not limited to. The bottom surface of the key cap 20 can further has a resting portion 24 formed at a periphery of the positioning protrusion 22 and slightly thinner than the positioning protrusion 22. The resting portion 24 can be fixed, such as adhered, to the top surface of the frame portion 12, so that the key cap 20 is fixed to the supporting plate 10. This is only one embodiment according to the instant disclosure. The key cap 20 can be made of opaque material, or where corresponded to the light-pervious opening 120 of the frame portion 12 is transparent, the other portion can be colored and shaded from light.

Please refer to FIG. 3. For the frame portion 12 having the bump 122, the resting portion 24 is partially extended on the top of the bump 122. When the key cap 20 is pressed, the resting portion 24 moved downwardly and pushed the frame portion 12 and the bump 122 to press the dome 30.

Figure 3A:
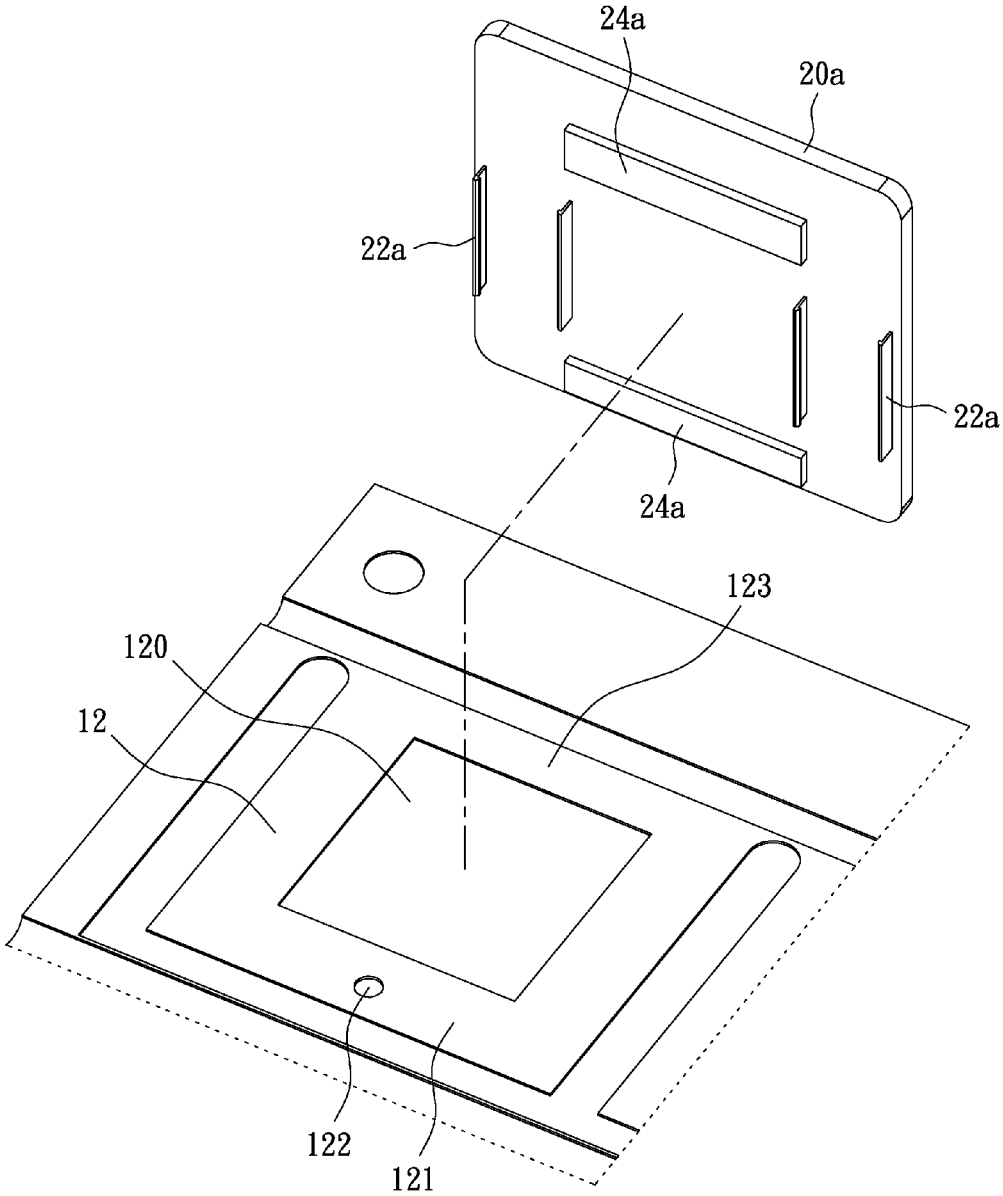
FIG. 3A is a perspective exploded view of slim keypad structure of second embodiment according to the instant disclosure.

Referring to FIG. 3A, which show a second embodiment of the key cap according to the instant disclosure. The difference between the key cap 20*a* in this embodiment and the forementioned embodiment is the fixing way. The key cap 20*a* uses a hook 22*a* at the bottom surface thereof to clip to two sides of the frame portion 12. Besides, the key cap 20*a* has a pair of resting portions 24*a* on the bottom surface thereof, so that it can be against the front portion and the rear portion of the frame portion 12 in a balance manner. The front bar 121 and the rear bar 123 of the frame portion. The resting portion 24*a* is also disposed on the bump 122.

Figure 3B:
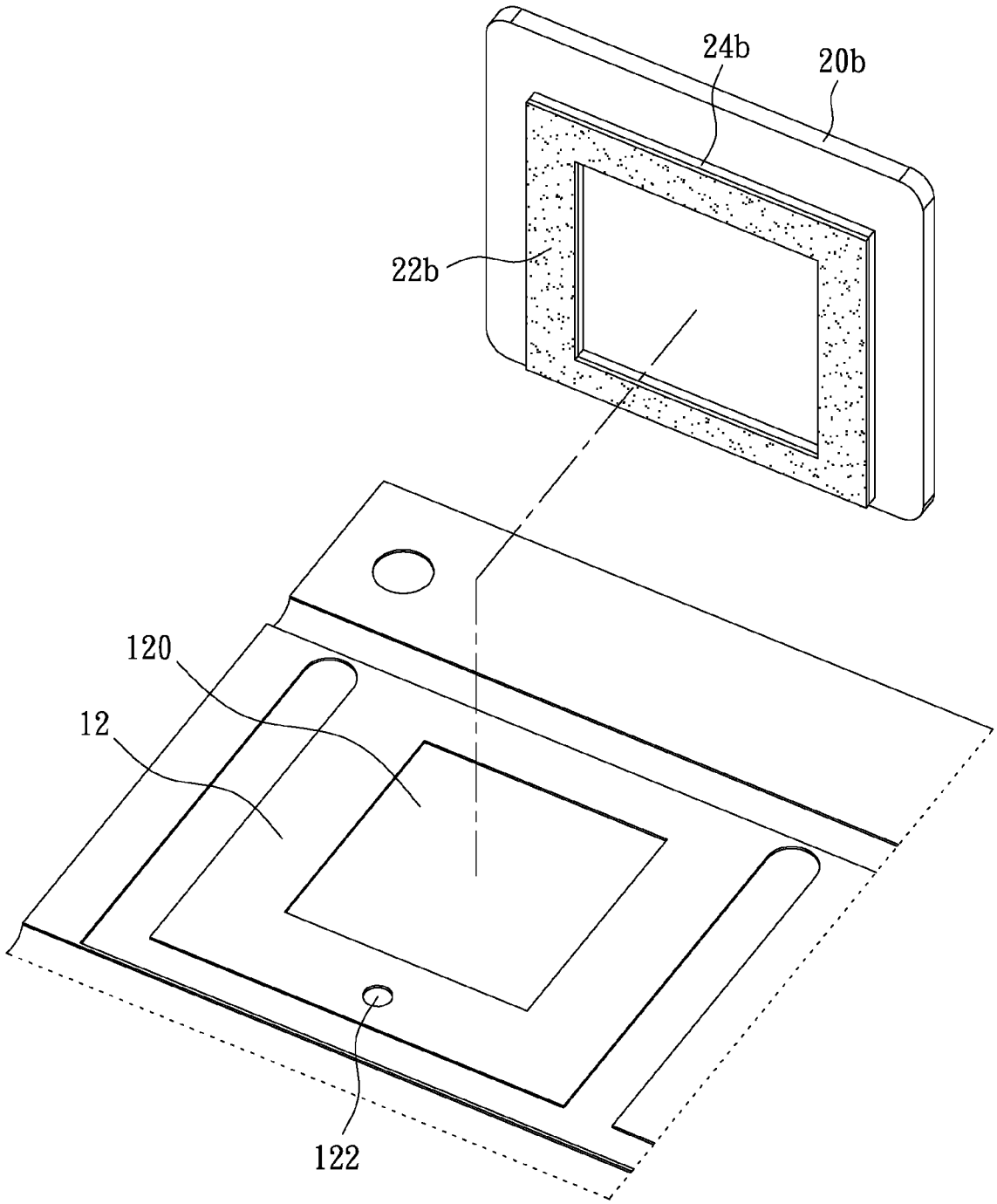
FIG. 3B is a perspective exploded view of slim keypad structure of third embodiment according to the instant disclosure.

Referring to FIG. 3B, which illustrates a third embodiment of the key cap according to the instant disclosure. The difference between this embodiment of the key cap 20*b* and the first embodiment is that the bottom surface of the key cap 20*b* only has a frame-shaped resting portion 24*b*, without positioning protrusion or hook. This embodiment uses an adhesive layer 22*b* of rectangle-frame shape adhered to the frame portion 12. The contour of the resting portion 24*b* is matched with that of the frame portion 12. The adhesive layer 22*b* can be twin adhesive or any kinds of adhesives could use to bind.

Figure 3C:
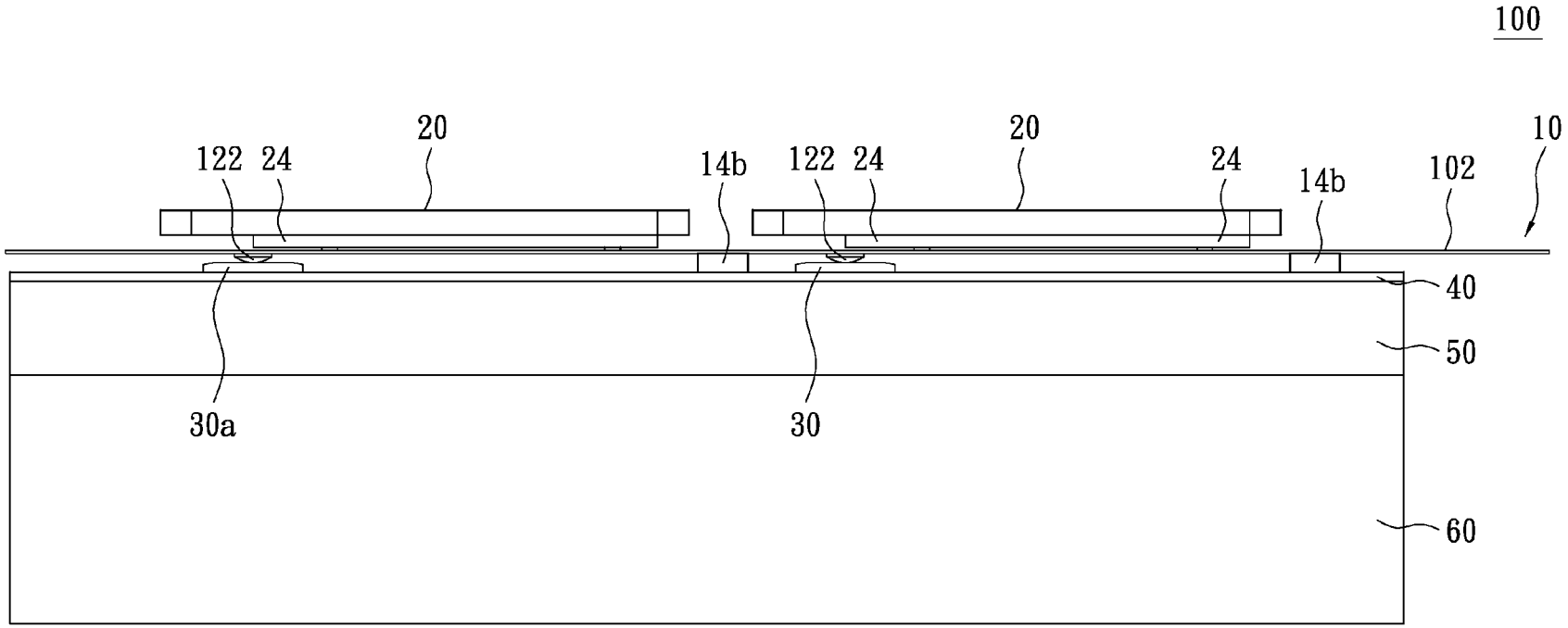
FIG. 3C is a side view of uplifted supporting plate of second embodiment according to the instant disclosure.

Referring to FIG. 3C, which is a side view of a supporting plate being uplifted of second embodiment according to the instant disclosure. This embodiment uses an independent uplifted block 14*b* disposed between the supporting plate 10 and the circuit board 40. The uplifted block 14*b* could be rectangular or half-circle shaped in a side view, and is adhered to a bottom surface of the supporting plate 10. Preferably the uplifted block 14*b* is bar-shaped and is disposed at one side of the frame portion 12 or between two neighboring rows of the frame portion 12.

Figure 3D:
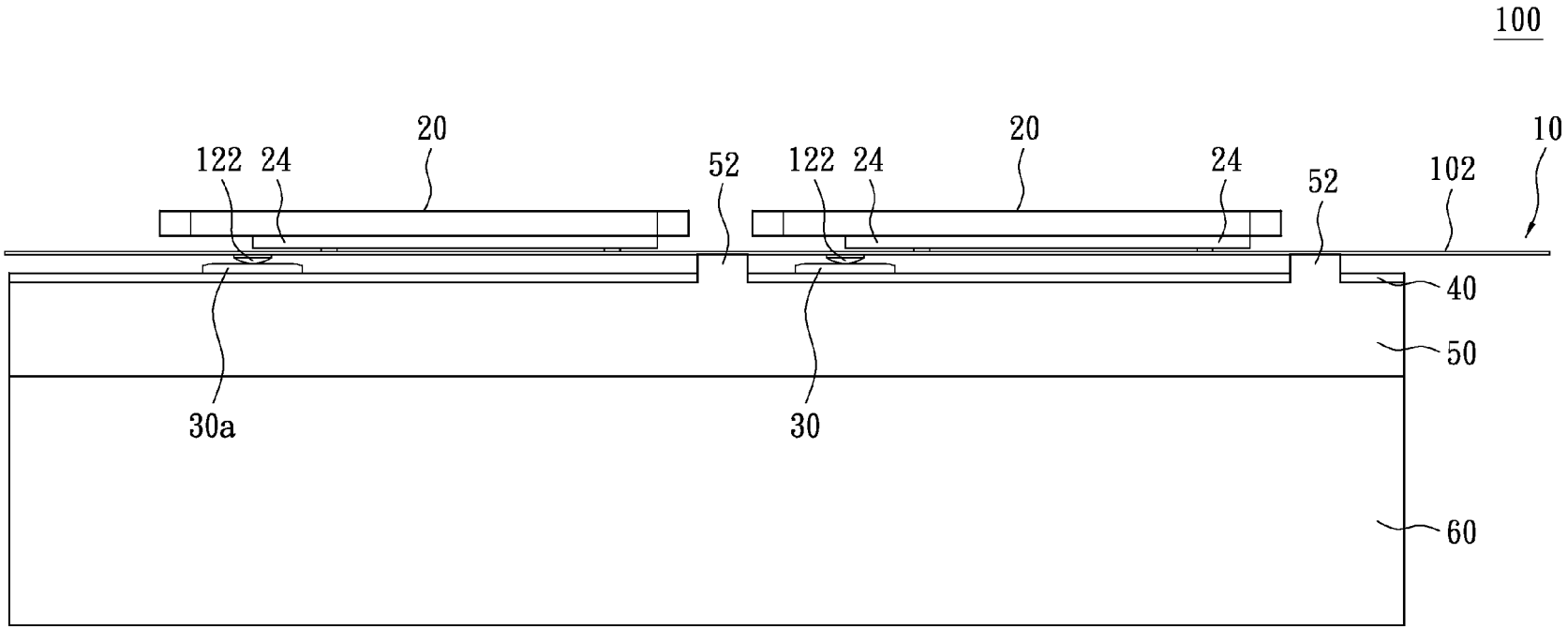
FIG. 3D is a side view of uplifted supporting plate of third embodiment according to the instant disclosure.

Referring to FIG. 3D, which is a side view of a supporting plate being uplifted of third embodiment according to the instant disclosure. This embodiment has an uplifted portion 52 integrally protruded upward from the bearing substrate 50. The uplifted portion 52 passes through the circuit board 40 and propped against the bottom surface of the supporting plate 10. The shape of the uplifted portion 52 could be in square column shape or half-column.

Referring to FIG. 1 and FIG. 3, the dome 30 is a metal slug in substantial half-sphere, which is disposed under the frame portion 12 opposite to the uplifted portion 14. When the key cap 20 is pressed, the dome 30 conducts a corresponding circuit on the circuit board 40 (not shown) to produce a signal and provides an elastic force. The circuit board 40 in this embodiment is made of light-transmissible material, and is printed with a plurality of conductive circuits under the domes 30 correspondingly.

The slim keypad structure 100 of this embodiment can further include a bearing substrate 50, which is disposed on the bottom surface of the circuit board 40. The bearing substrate 50 is used to support the elements of the keypad structure, which could be transparent board, such as a transparent glass or plastic. The bearing substrate 50 also could be a light-guiding board as light source cooperated with LEDs, and formed with a plurality of micro-structure corresponding to the light-pervious openings 120 as back light for the key cap 20.

Figure 4:
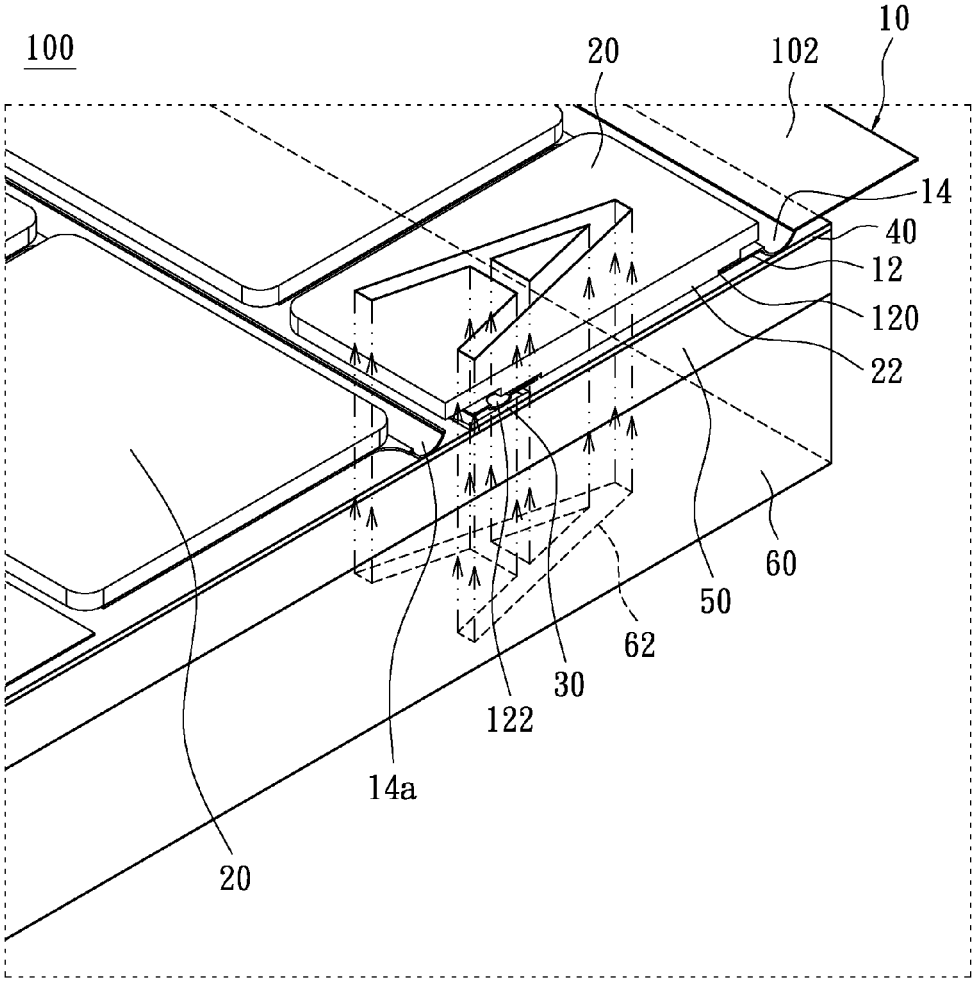
FIG. 4 is a perspective cross-sectional view of slim keypad structure according to the instant disclosure.

Referring to FIG. 1 and FIG. 4, wherein FIG. 4 is a perspective cross-sectional view of slim keypad structure 100. Another characteristic of the slim keypad structure according to the instant disclosure is that the key cap 20 does not need to print with symbols or characters. The slim keypad structure 100 can further include a displaying element 60 to show at least one symbol through the circuit board 40, the light-pervious opening 120 of the supporting plate 10 and corresponding to the key cap 20. Preferable the displaying element 60 is a liquid display panel, which can output different symbols by a central processing unit, such as the symbol 62 "A" shown in FIG. 4 and displayed on the key cap 20 through the light-pervious opening 120 of the frame portion 12. Even if the displaying element 60 is rigid enough, such as tempered glass, the bearing substrate 50 of the instant disclosure could be omitted, and the circuit board 40 is directly formed on the displaying element 60.

The instant disclosure can display different symbols on one same key cap 20 through the displaying element 60. In other words, the same one key cap can show different symbols to match with different controlling commands according to different requirements. For example, the slim keypad structure can be mounted on a tablet personal computer, and the displaying element 60 projects different symbols on the same key cap 20 according to the requirement of programs. In the example of electronic reading software, different symbols can be provided by the displaying element 60 on the same key cap 20 of one keypad structure, such as "upward", "downward", "forward", "rearward". In other electronic games, the same key cap 20 can show different symbols of "attack", "pause" "escape" . . . etc. The circuit board 40 is electrically connected to the center processing process of the electronic device, so that the conductive circuit simultaneously produces different controlling signals correspondingly. The slim keypad structure of the instant disclosure makes electronic devices are more flexible on operations, and do not need many keypad structure.

The displaying element 60 also can be other types, such as printing, or light colors. For example, a LED can be mounted therein to provide different light colors. A supplementary description, the displaying element 60 is not a necessary element in the instant disclosure. For example, the key cap 20 can be made of opaque material and printed with symbol directly, which is enough for a normal operation of the slim keypad structure of the instant disclosure.

Figure 5:
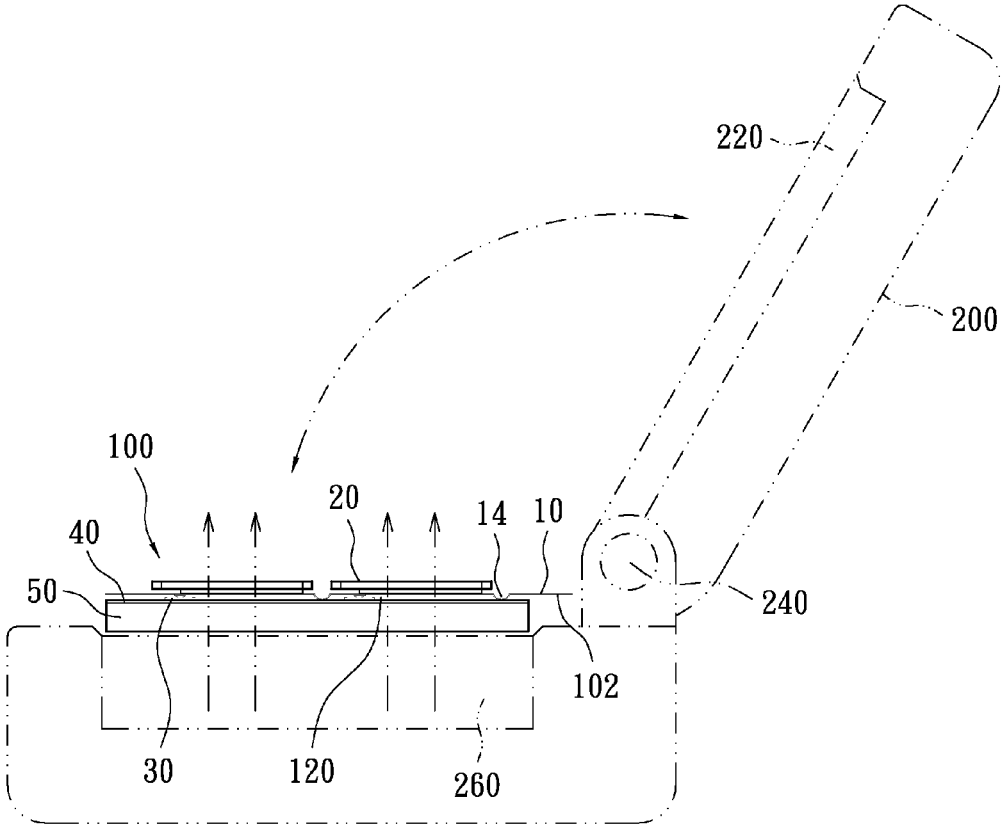
FIG. 5 is a perspective view of an electronic device having the slime keypad structure according to the instant disclosure.

Referring to FIG. 5, which is shown the slim keypad structure 100 is disposed on an electronic device 200 according to the instant disclosure. Besides, the slim keypad structure 100, the electronic device 200 includes a first display 220, a second display 260 and a pivoted device 240 connected the first and second displays 220, 260 for a cover liftable function. The first display 220 and the second display 260 preferably can be slim liquid crystal display. The second display 260 can be used as the above-mentioned displaying element. In other words, the second display 260 of the electronic device 200 can be used to display symbol through the circuit board 40 and the light-pervious opening 120 of the supporting plate 10, then is shown on the top surface of the key cap 20 correspondingly. In this embodiment, the symbol is shown on the key cap 20 by the second display 260, so that the slim keypad structure 100 does not need the displaying element 60, just needs the supporting plate 10, the key cap 20, the dome 30, the circuit board 40 and the bearing substrate 50. Even if the second display 260 of the electronic device 200 is rigid enough, the bearing substrate 50 can be omitted.

The supporting plate 10 of the instant disclosure can further include a fixing portion 102 extended from an outer side of the frame portion 12. In this embodiment, the fixing portion 102 is extended outwardly from the uplifted portion 14. The fixing portion 102 is connected to the electronic device 200, such as to the pivoted device 240, even is pivotably connected to the electronic device 200. When it is lifted upward, the second display 260 can be used as other function.

To sum up, the instant slim keypad structure has the following disadvantages and features as followed. The slim design makes the thickness of the electronic device is reduced effectively. All the elements are simplified and easily to assembly, thus the cost can be reduced. The instant disclosure can be applied on portable electronic devices, such as mobile phone, tablet personal computer . . . etc., to provide well pressing sense of touch, instead of touch panel. The same keypad structure can show different symbols, so that the operation is more flexible.

The description above only illustrates specific embodiments and examples of the instant disclosure. The instant disclosure should therefore cover various modifications and variations made to the herein-described structure and operations of the instant disclosure, provided they fall within the scope of the instant disclosure as defined in the following appended claims.

What is claimed is:

1. A slim keypad structure, comprising:

a supporting plate, having at least one frame portion, and an uplifted portion downwardly protruded from an edge of the at least one frame portion, each frame portion formed with a light-pervious opening at a central portion thereof;

at least one key cap, disposed on a top surface of the frame portion correspondingly;

at least one dome, disposed under the frame portion correspondingly; and a light-penetrable circuit board, having at least one conducted circuit correspondingly formed under the dome, wherein the supporting plate is arranged above the circuit board with an interval.

2. The slim keypad structure of claim 1, wherein the uplifted portion is downward curve-shaped and is parallel with one side of the frame portion.

3. The slim keypad structure of claim 1, wherein each key cap has a resting portion protruded outwardly from a bottom surface of the key cap, the resting portion is against the top surface of the frame portion.

4. The slim keypad structure of claim 3, wherein the key cap further includes a positioning protrusion outwardly protruded from a part of the bottom of the resting portion, the positioning protrusion is disposed in the light-pervious opening.

5. The slim keypad structure of claim 4, further comprising a displaying element for showing at least one symbol, and the key cap is made of transparent material, the symbol is shown on a top surface of the key cap through the circuit board and the light-pervious opening of the supporting plate correspondingly.

6. The slim keypad structure of claim 5, wherein the displaying element is an LCD of an electronic device.

7. The slim keypad structure of claim 3, wherein the key cap further includes at least one hook formed on a bottom thereof to engage with the frame portion.

8. The slim keypad structure of claim 3, wherein the key cap further includes an adhesive layer disposed on a bottom of the resting portion, and the adhesive layer is attached to the frame portion.

9. The slim keypad structure of claim 1, wherein the supporting plate has the frame portions arranged in a plurality of rows, each of the frame portions is formed with a hollowed slot at an outer side thereof.

10. The slim keypad structure of claim 9, wherein the frame portion has a downward bump, the bump is against the dome.

11. The slim keypad structure of claim 1, further comprising a bearing substrate is disposed on a bottom surface of the circuit board, the bearing substrate is a transparent board.

12. The slim keypad structure of claim 1, wherein the supporting plate further includes a fixing portion arranged at an outer side of the frame portion.

13. An electronic device with slim keypad structure, comprising a slim keypad structure including:

a supporting plate having at least one frame portion, and an uplifted portion downwardly protruded from an edge of the at least one frame portion, each frame portion is formed with a light-pervious opening at a central portion thereof;

at least one key cap, disposed on a top surface of the frame portion correspondingly;

at least one dome, disposed under the frame portion correspondingly;

a light-penetrable circuit board, having at least one conducted circuit correspondingly formed under the dome, wherein the supporting plate is arranged above the circuit board with an interval; and a displaying element, displaying at least one symbol, wherein the symbol is shown on a top surface of the key cap through the circuit board and the light-pervious opening of the supporting plate.

14. The electronic device with slim keypad structure of claim 13, wherein the uplifted portion is downward curve-shaped and is parable with one side of the frame portion.

15. The electronic device with slim keypad structure of claim 13, wherein each key cap has a resting portion protruded outwardly from a bottom surface of the key cap, the resting portion is against the top surface of the frame portion.

16. The electronic device with slim keypad structure of claim 15, wherein the key cap further includes at least one hook formed on a bottom thereof to engage with the frame portion.

17. The electronic device with slim keypad structure of claim 15, wherein the key cap further includes an adhesive layer disposed on a bottom of the resting portion, and the adhesive layer is attached to the frame portion.

18. The electronic device with slim keypad structure of claim 13, wherein the key cap further includes a positioning protrusion outwardly protruded from a part of the bottom of the resting portion, the positioning protrusion is disposed in the light-pervious opening.

19. The electronic device with slim keypad structure of claim 13, wherein the supporting plate has the frame portions arranged in a plurality of rows, each of the frame portions is formed with a hollowed slot at an outer side thereof.

20. The electronic device with slim keypad structure of claim 19, wherein the frame portion has a downward bump, the bump is against the dome.

21. The electronic device with slim keypad structure of claim 13, further comprising a bearing substrate is disposed on a bottom surface of the circuit board, the bearing substrate is a transparent board.

22. The electronic device with slim keypad structure of claim 13, wherein the displaying element is a liquid crystal display.

23. The electronic device with slim keypad structure of claim 13, wherein the supporting plate further has a fixing portion extended from an outer side of the frame portion.

* * * * *